US010830564B1

(12) United States Patent
Langenbeck

(10) Patent No.: US 10,830,564 B1
(45) Date of Patent: Nov. 10, 2020

(54) FIREARM AND AMMUNITION SYSTEM

(71) Applicant: Keith A. Langenbeck, Pleasant View, TN (US)

(72) Inventor: Keith A. Langenbeck, Pleasant View, TN (US)

( * ) Notice: Subject to any disclaimer, the term of this patent is extended or adjusted under 35 U.S.C. 154(b) by 0 days.

(21) Appl. No.: 16/514,649

(22) Filed: Jul. 17, 2019

(51) Int. Cl.
*F42B 30/02* (2006.01)

(52) U.S. Cl.
CPC ..... *F42B 30/02* (2013.01)

(58) Field of Classification Search
CPC ..... F42B 30/02
USPC ..... 102/501
See application file for complete search history.

(56) References Cited

U.S. PATENT DOCUMENTS 1,376,530 A * 5/1921 Greener ..... F42B 5/03 102/438
5,443,010 A * 8/1995 Dahlitz ..... F42B 14/04 102/501
2015/0337878 A1* 11/2015 Schlosser ..... F01N 13/082 181/213
2016/0153757 A1* 6/2016 Mahnke ..... F42B 12/02 102/501
2016/0290774 A1* 10/2016 Langenbeck ..... F42B 5/025
2017/0322002 A1* 11/2017 Mahnke ..... F42B 12/74

* cited by examiner

*Primary Examiner* — Samir Abdosh
(74) *Attorney, Agent, or Firm* — Lyman Moulton, Esq.; Moulton Patents, PLLC.

(57) ABSTRACT

An improved bullet comprises a bullet shank having at least one reduced diameter waist, a sleeve adapted to fill out the at least one reduced diameter waist so that a diameter of the sleeve over the shank waist is equal to or slightly greater than a minimum diameter of the firearm freebore and slightly greater than a bore of the rifle barrel. The improved bullet also includes an annular dimple in a base of the bullet, the annular dimple comprising at least one of one or more annular troughs, a cylindrical counter bore and a concave counter bore in the bullet base. Also, a first curve segment and the second curve segment on the sleeve of the bullet form a repeated 'S' shaped profile on the bullet shank.

20 Claims, 15 Drawing Sheets

FIREARM AND AMMUNITION SYSTEM

CROSS-REFERENCE TO RELATED APPLICATION

This application claims the benefit of the priority date of earlier filed U.S. Provisional Patent Application Ser. No. 62/699,464 titled 'Improved Firearm and Ammunition System' filed Jul. 17, 2019 by Keith A. Langenbeck, and is incorporated herein by reference in its entirety.

BACKGROUND OF THE INVENTION

The field of aerodynamic design for projectiles, aircraft, rockets and the like is extensive. The physical size of small caliber bullets/projectiles presents challenges not encountered in aircraft wing, ballistic missile, artillery shell or aircraft delivered bomb design. For small caliber weapons like handguns, shotguns, rifles and machine guns, performance enhancements have for decades been incremental at best.

The search for improved performance in handgun cartridges with better bullet external ballistics and terminal effects continues unabated. It is not uncommon for Law Enforcement organizations to have issued 9 mm Luger/Parabellum (9×19 mm) semi-automatic duty pistols in the 1990's only to change to 40 Smith & Wesson caliber (10×22 mm) in the 2000's and now are reverting back to the 9 mm Luger. The reasons for changing back to the 9 mm from the 40 S&W include:

- advances in 9 mm bullet design,
- increased muzzle energy in +P loadings,
- reduced recoil versus 40 S&W, 357 SIG and 45 ACP
- longer service life of the weapon,
- quicker and more accurate follow up shots due to reduced recoil,
- lower cost ammunition and others.

Another distinct advantage of the 9 mm Luger is its smaller case diameter, which results in greater magazine capacity versus similar sized pistols chambered in 40 S&W (based on the 10 mm Auto case dimensions), 357 SIG (Schweizerische Industrie-Gesellschaft, also based on the 10 mm Auto case dimensions), 10 mm Auto, 38 Super (semi-rimmed case) and 45 ACP (Automatic Colt Pistol) pistols. Recent reports from the FBI (Federal Bureau of Investigation) affirm that the terminal effects and wound damage for modern 9 mm Luger cartridges/bullets versus 40 S&W and 45 ACP are essentially the same.

The 9 mm Luger is considered to be the most popular centerfire pistol cartridge in the world. The 9 mm Luger, aka 9 mm NATO (North Atlantic Treaty Organization), is the standard center fire pistol cartridge for the US military and its NATO allies. However during the summer of 2014, the US Army announced a new pistol procurement program known as the Modular Handgun System. The program intends not only to replace approximately 400,000 Beretta M9 and SIG Sauer M11 pistols, but is seeking alternative cartridges to the 9 mm NATO.

Different than Law Enforcement engagements, the military can frequently encounter soft body armor or thick clothing that the 9 mm Luger fails to effectively penetrate. Spokesmen for the Modular Handgun Caliber procurement have stated that the replacement caliber " . . . must exceed the performance of the current M882 9 mm round." and " . . . provide the soldier with increased terminal performance," and "feedback from soldiers in the field is that they want increased 'knock-down power."

The difference in ballistic efficiency for the same projectile diameter used in common handguns and rifles is vast. Handgun projectiles are typically designed for close range and rifles for more distant targets. The different applications affect the overall size of the weapon, bullet shape, bullet diameter, bullet length, cartridge overall length, magazine capacity and projectile performance. For example, common 30 caliber bullets for handguns have a diameter from 0.309 to 0.312 inches, weigh from 80 to 110 grains and have ballistic coefficients of around 0.100 to 0.150.

Common 30 caliber bullets for rifles have a diameter from 0.303 to 0.311 inches, weigh from 110 to 220 grains and have ballistic coefficients of around 0.250 to 0.450. The lower the ballistic coefficient, the quicker the bullet loses velocity and useful range. Nose profile or shape, ratio of bullet length to diameter, shape of the end of the projectile and other design aspects significantly affect the ballistic coefficient. Typically handgun bullets are larger in diameter than rifle bullets. The 30 caliber cartridges best illustrate the performance variations between handgun and rifle bullets of the same nominal diameter.

The Tokarev handgun cartridge from the Soviet Union, also known as the 7.62×25 mm, commonly has a bullet diameter of 0.309 inches, bullet length of 0.52 inches for a 90 grain weight, case diameter of 0.387 inches, cartridge overall length of 1.34 inches, muzzle velocity of 1400-1700 feet per second from a 4.5 inch barrel, ballistic coefficient of 0.142 and an effective range to 50 meters+/−. The well-known rifle cartridge .308 Winchester, also known as 7.62×51 mm NATO, commonly has a bullet diameter of 0.308 inches, bullet length of 1.15 inches for a 165 grain weight, case diameter of 0.470 inches, cartridge overall length of 2.81 inches, muzzle velocity of 2600-2800 feet per second from a 20 inch barrel, ballistic coefficient of 0.450 and an effective range of 800 meters+/−.

Trying to use lighter weight rifle bullets in a pistol application like the Tokarev results in functional compromises or are simply unworkable. Properly seating a tapered nose, longer bullet can extend the cartridge overall length beyond the physical constraints of the magazine and the breech or cannibalize case capacity for the propellant needed to move the bullet at desired velocities.

SUMMARY OF THE INVENTION

An improved bullet and freebore for a rifle barrel of a firearm comprises a bullet shank having at least one reduced diameter waist, a sleeve adapted to fill out the at least one reduced diameter waist so that a diameter of the sleeve over the shank waist is equal to or slightly greater than a minimum diameter of the firearm freebore and slightly greater than a bore of the rifle barrel. The improved bullet also includes an annular dimple in a base of the bullet, the annular dimple comprising at least one of one or more annular troughs, a cylindrical counter bore and a concave counter bore in the bullet base. Also, a first curve segment on the sleeve of the bullet comprises a convex center point within a shank profile of the bullet and forms an annular dimple therein. A second curve segment on the sleeve of the bullet comprises a concave center point outside the shank profile of the bullet and forms an annular trough there around. The first curve segment and the second curve segment form a repeated 'S' shaped profile on the bullet shank. The waisted sleeve and annularly dimpled base are configured to extend an effective flight range and a Coanda effect there around reducing air turbulence and drag on the bullet shank in flight.

Other aspects and advantages of embodiments of the disclosure will become apparent from the following detailed description, taken in conjunction with the accompanying drawings, illustrated by way of example of the principles of the disclosure.

Figure 1:
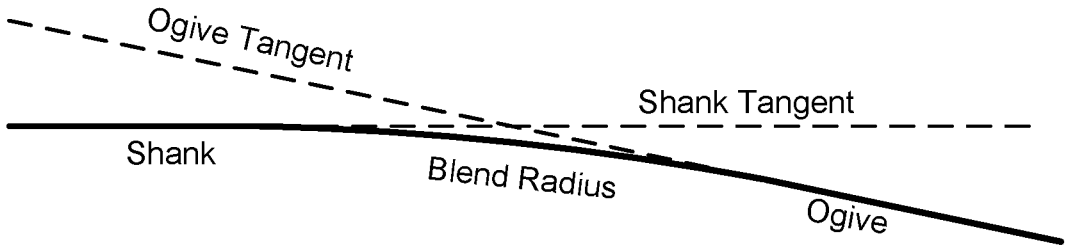
FIG. 1 depicts a close up pictorial view of a dual tangent blend radius at the intersection of the cone ogive to the shank on an improved pistol bullet in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This application discloses novel and unobvious improvements to projectile performance and launch systems in small caliber weapons but the features and performance benefits could be applied to large caliber projectiles as well. Throughout the present disclosure and continuances and/or divisional disclosures thereof, the terms 'slug,' 'bullet,' and 'projectile' may be used interchangeably to generally define a solid mass expelled from a firearm, usually explosively. The term 'nominal' used throughout may define a measurement or a metric near a mean in a normal distribution. Furthermore, the term 'plateau' used in the present disclosure refers to a conventional definition thereof meaning a relatively level surface considerably raised above adjoining surfaces. The term 'waist' refers to a narrowing or at least one of a narrowest part of a shank of a bullet affected by machining or molding or other means before and after manufacture.

FIG. 1 depicts a close up pictorial view of a dual tangent blend radius at the intersection of the cone ogive to the shank on an improved pistol bullet in accordance with an embodiment of the present disclosure. A blend radius is disposed between a first tangent thereof intersecting a shank of the bullet and a second tangent thereof intersecting a cone ogive.

Figure 2:
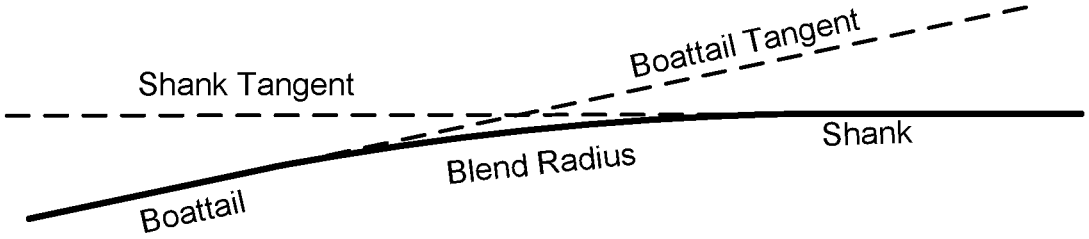
FIG. 2 depicts a close up pictorial view of a dual tangent blend radius at the intersection of the shank to the boattail on an improved pistol bullet in accordance with an embodiment of the present disclosure.

FIG. 2 depicts a close up pictorial view of a dual tangent blend radius at the intersection of the shank to the boattail on an improved pistol bullet in accordance with an embodiment of the present disclosure. Therefore a dual tangent blend radius is configured to extend an effective flight range and a Coanda effect there around reducing air turbulence and drag on the bullet in flight.

Figure 3:
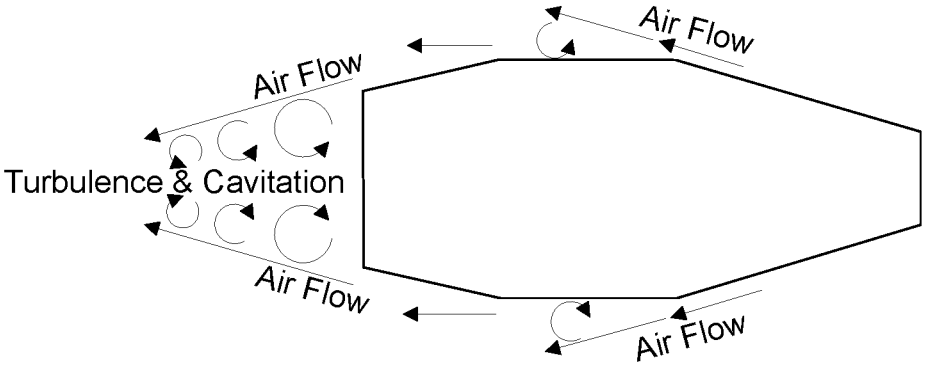
FIG. 3 depicts the cavitation and turbulent air flow around the cone, shank and base end of a conventional bullet.

FIG. 3 depicts the cavitation and turbulent air flow around the cone, shank, boattail and base end of a conventional bullet. The cavitation and turbulence are set up at sharp transitions of one surface to another and slow the bullet down and decrease its effective range, as compared to the disclosed improved bullet.

Figure 4:
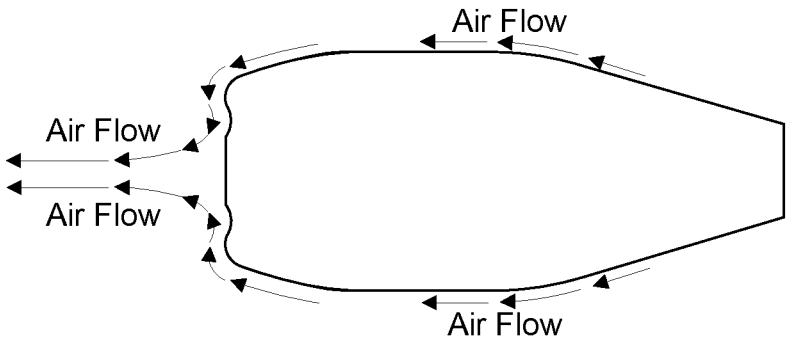
FIG. 4 depicts the Coanda effect air flow around the ogive cone, shank, boattail and dimpled base end of an improved pistol bullet in accordance with an embodiment of the present disclosure.

FIG. 4 depicts the Coanda effect air flow around the ogive cone, shank, boattail and dimpled base end of an improved pistol bullet in accordance with an embodiment of the present disclosure. The Coanda effect design acts to reduce the wake turbulence by folding the air around the base of the bullet, collapsing or closing the diameter of the air disturbance and turbulence after the bullet base, as if the boattail cone of the bullet was much longer.

Figure 5:
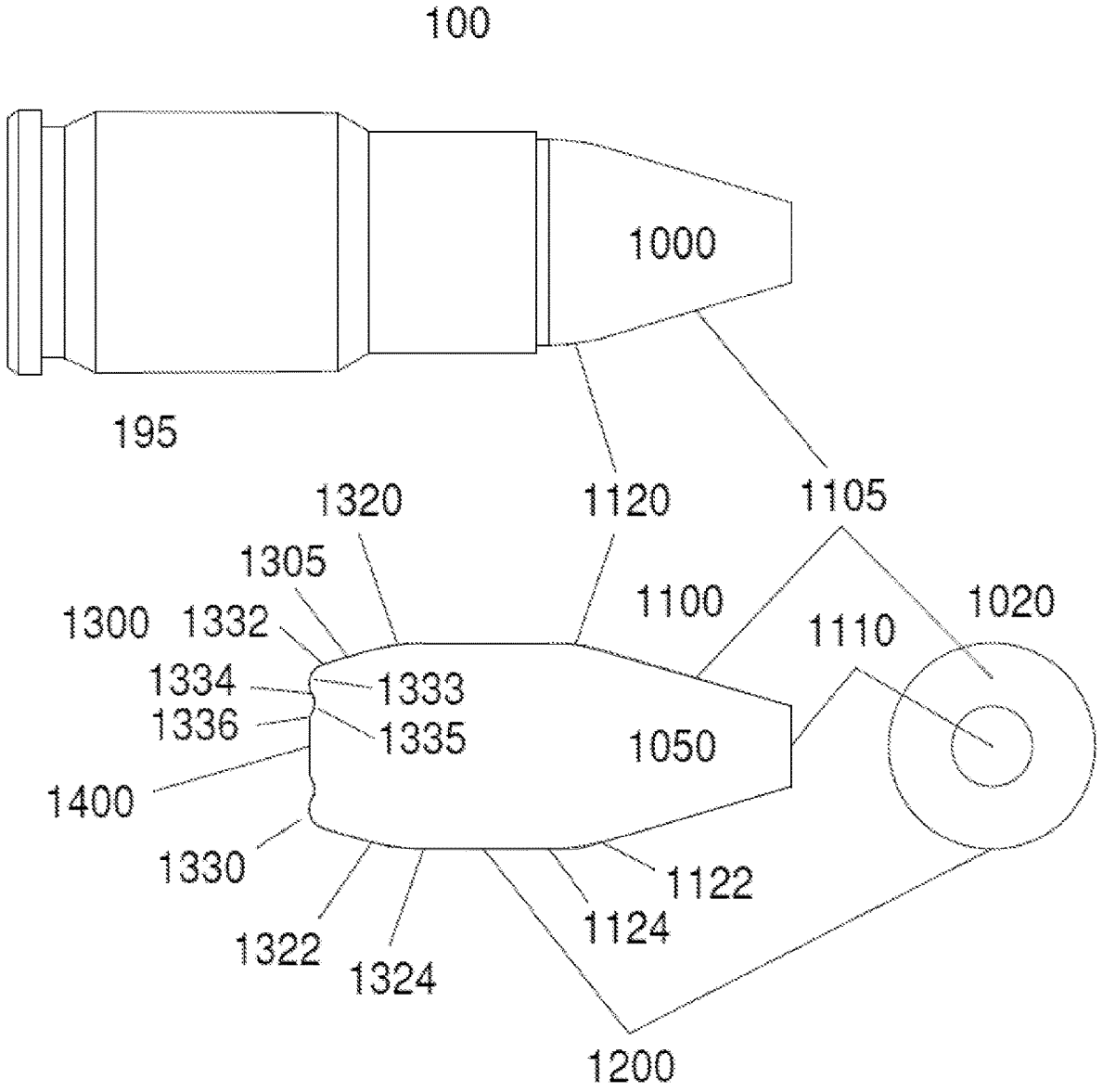
FIG. 5 depicts an assembled cartridge and a dimpled base bullet with a truncated cone, ogive, boattail and dual tangent blend radii in accordance with an embodiment of the present disclosure.

FIG. 5 depicts an assembled cartridge and a dimpled base bullet with a truncated cone ogive and dual tangent blend radii in accordance with an embodiment of the present disclosure. The improved pistol bullet includes at least one dimple formed into a base of the bullet adjacent to the boattail, the dimple adapted to effect a Coanda air flow around the base and reduce a turbulence and a drag on the bullet in flight. The improved pistol bullet additionally includes a curved segment joining the dimpled base and the boattail cone, the curved segment configured to effect a Coanda air flow across the curved segment. The improved pistol bullet further includes a truncated cone ogive with a meplat end and a shank end, the truncated cone ogive adapted to produce less drag and friction in air than a secant or a tangent ogive.

FIG. 5 details a dimpled base bullet with a truncated cone ogive and a dual tangent blend radius in accordance with an embodiment of the present disclosure. Different than common elliptical profile bullets, FIG. 5 shows Item 100 with a different bullet, Item 1000, inserted with the brass case, Item 195. Immediately below the assembled cartridge, Item 100, is a cross sectional view, Item 1050, down the major axis of the entire bullet that has been removed from the cartridge case, Item 195. Immediately to the right of Item 1050 is an end view, Item 1020, of the solid bullet, Item 1000.

The shape of the bullet ogive, Item 1100, is that of a truncated cone portion, Item 1105, in conjunction with a radius portion, Item 1120, which transitions or blends the ogive with the bearing portion or shank of bullet, Item 1200. The bearing portion of the bullet is nominally cylindrical with an outside diameter and known as the bullet caliber. In the case of the 30 SK™ and 30 Super™ the outside diameter of Item 1200 is 0.308". The 30 SK™ and 30 Super™ marks indicate a distinctive source of the disclosed bullets to consumers. The leading, flat portion of the truncated cone, Item 1110, is known as the meplat, a French noun which means "the flat of". The exterior surface of the conical portion, Item 1105, intersects tangent with the blend radius, Item 1120, at Item 1122. The blend radius, Item 1120, intersects tangent with the bearing portion of the bullet, Item 1200, at Item 1124.

As drawn in FIG. 5, the radius of curvature for Item 1120 is 1 caliber or 0.308". This results in the cone diameter at Item 1122 being smaller than the inside diameter of the rifle lands. For a pistol that fires 0.308" diameter bullets the grooves of the rifling are nominally 0.308" and the lands of the rifling are nominally 0.300".

Another aspect of this invention discloses a unique boattail cone, Item 1300, a tapering portion of the bullet that comes after the cylindrical bearing portion of the bullet, Item 1200. Item 1320 is the blend radius from Item 1200 to Item 1305. Item 1305 is the truncated conical portion of the boattail, Item 1300. The exterior surface of Item 1200 intersects tangent with the blend radius, Item 1320, at Item 1324. The blend radius, Item 1320, intersects tangent with Item 1305 at Item 1322. The radius of curvature and arc length of Item 1320 are the same as the radius of curvature and arc length as Item 1120, effectively mirror images of the other. Although shorter in length than Item 1105, Item 1305 has the same cone angle as Item 1105.

After the truncated cone portion, Item 1305, and prior to bullet base, Item 1400, there are various curved segments, Item 1330. The intent of curve segments, Item 1330, is to induce the Coanda effect at the back end of the bullet, Item 1000, to reduce wake turbulence, related drag and improve the ballistic efficiency while in flight. Typically, the flat base of a bullet intersects the conical portion of its bottail in a sharp angle, resulting in significant wake turbulence trailing after the bullet. The result of Item 1330 is akin to the aerodynamic benefit of dimples on a golf ball, which induce the air to more fully envelope the ball, reducing the wake turbulence and adding distance to the flight of a dimpled golf ball versus a smooth surface golf ball.

Item 1332 is the tangent intersection point of Item 1305 and the first curve segment, Item 1333. Item 1334 is the tangent intersection point of Item 1333 and the second curve segment, Item 1335. Item 1333 lies anterior or tangent to Item 1400 and has a center point within the cross sectional profile of the bullet, Item 1050. Item 1336 is the terminal intersection point of Item 1335 and Item 1400. Item 1335 lies anterior to Item 1400 and has a center point outside the cross sectional profile of the bullet, Item 1050. The first curve segment 1333 and the second curve segment 1335 form an 'S' shaped cross-section with the first curve segment 1333 forming an annular ridge and the second curve segment 1335 forming an annular trough in the bullet base 1400. A plateau center portion of the base 1400 lies in a plane intersecting the center points of the curved segments orthogonal to a central axis of the bullet.

The aerodynamic benefits of the features described in Item 1300 apply even more so to conventional rifle bullets, such as those used in the 308 Winchester/7.62×51 mm NATO cartridge. Bullets used in that cartridge are longer in overall length with greater fineness and aspect ratios and significantly higher muzzle velocities than the same 0.308" diameter bullets in the 30 SK™ and 30 Super™. Given the same ogive length, bullet diameter and meplat diameter, the truncated cone ogive with the dual tangent blend radius described herein is: (1) less blunt than tangent, secant or hybrid secant ogives resulting in less related drag due to the smaller primary shock and (2) have less surface or wetted area than tangent, secant or hybrid secant ogives resulting is less drag due to friction.

Additionally, secant ogives are not tangent the shank of the bullet at the point of intersection. Depending on the ogive length, ogive radius of curvature and fineness ratio, the non-tangent intersection of a secant ogive with the shank of the bullet can cause secondary shock waves, which is not the case with tangent ogives and truncated cone ogives with the dual tangent blend radius.

Figure 6:
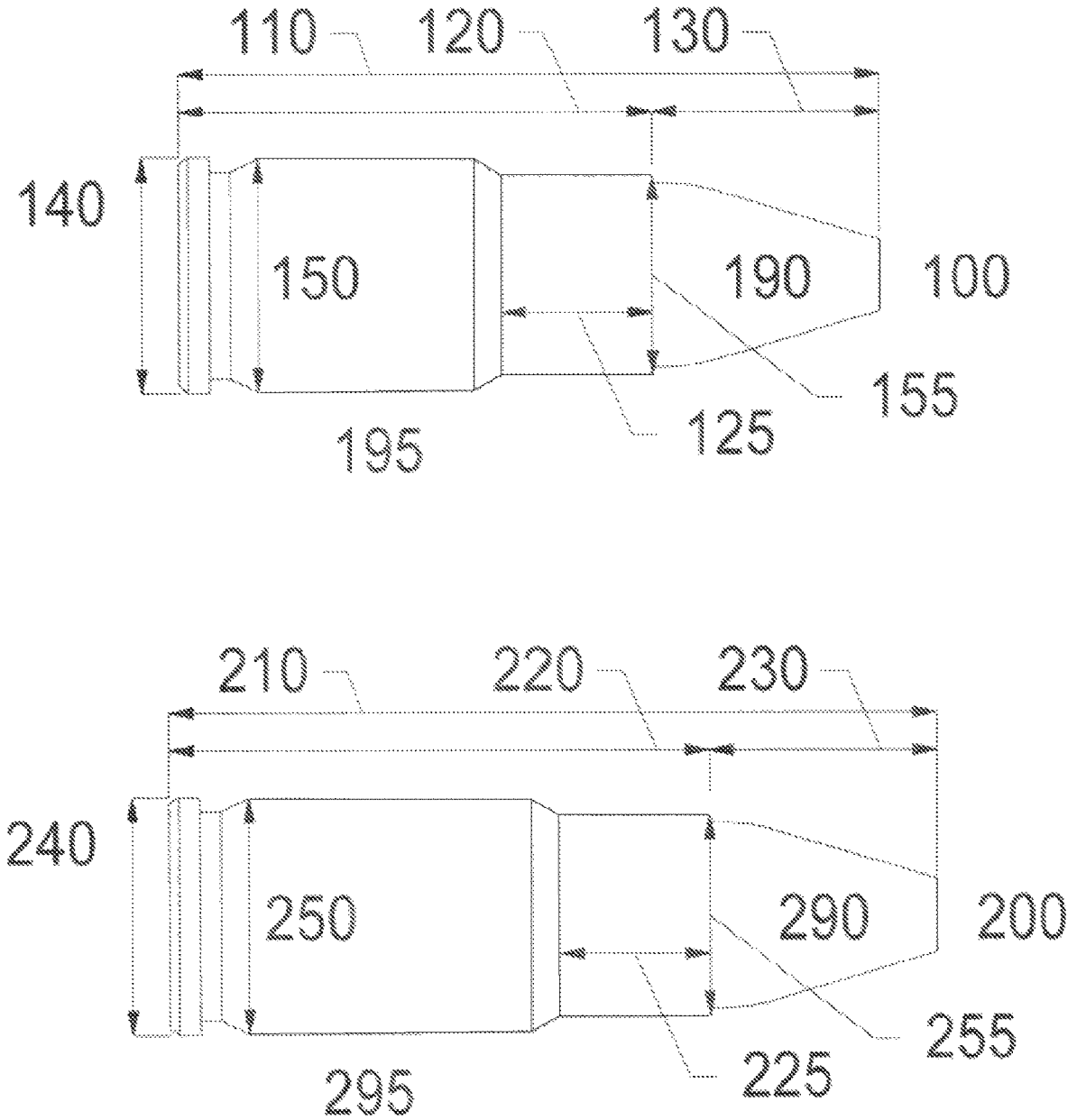
FIG. 6 depicts an improved first and an improved second pistol cartridge and respective improved pistol bullets therein in accordance with an embodiment of the present disclosure.

FIG. 6 depicts an improved first and an improved second pistol cartridge bullet in accordance with an embodiment of the present disclosure. Item 110 indicates the COAL for the 30 SK. Item 120 indicates the Case Length for the 30 SK. Item 125 indicates the Bottleneck Length for the 30 SK. Item 130 indicates the Ogive Length for the 30 SK. Item 140 indicates the Rim Diameter for the 30 SK. Item 150 indicates the Base Diameter for the 30 SK. Item 155 indicates the Neck Diameter for the 30 SK. Item 190 indicates the bullet loaded in the 30 SK. Item 195 indicates the brass case that contains the primer, gun powder (not shown) and bullet, Item 190, within. The reference numbers in the two hundred series are similarly indicated.

One aspect of this invention discloses a new cartridge with external ballistic and terminal performance superior to the 9×19 mm Luger in regular and +P and +P+ pressure designations, 40 S&W and 357 SIG, while utilizing the existing pistol magazines and requiring only a change of the barrel and recoil spring. Medium frame semi-automatic pistols in these calibers are designed for centerfire cartridges with a Cartridge Over All Length (COAL) typically less than or equal to the 9×19 mm Luger, which is 1.169". This drop-in-replacement cartridge for the 9×19 mm Luger will be derived from the 9×23 mm Winchester case that has been necked down for 30 caliber bullets (0.308" bullet diameter) and shortened to result in a COAL that is the essentially the same as 9×19 mm. The designation for this new cartridge is 7.62×20 mm and to be known as the 30 SK™.

Another aspect of this invention discloses a new 30 caliber cartridge again based on the 9×23 mm Winchester case resulting in superior external ballistic and terminal performance to the above referenced 7.62×20 mm. This cartridge will be designated as the 7.62×23 mm and to be known as the 30 Super. This cartridge is designed to be a drop-in-replacement with a new barrel and recoil spring for larger frame pistols that fire longer cartridges like the 38 Super, 10 mm Automatic, 9×23 mm Winchester and 45 ACP, which have a range of COALs from 1.26" to 1.30". The 30 Super will be derived from the 9×23 mm Winchester case that has been necked down for 30 caliber bullets (0.308" bullet diameter) and result in a nominal COAL of 1.28". The case length of the 30 Super, 0.900", will be the same as the case of the 9×23 mm Winchester. The 30 Super is essentially a longer version of the 30 SK with greater powder volume underneath the seated bullet.

Figure 7:
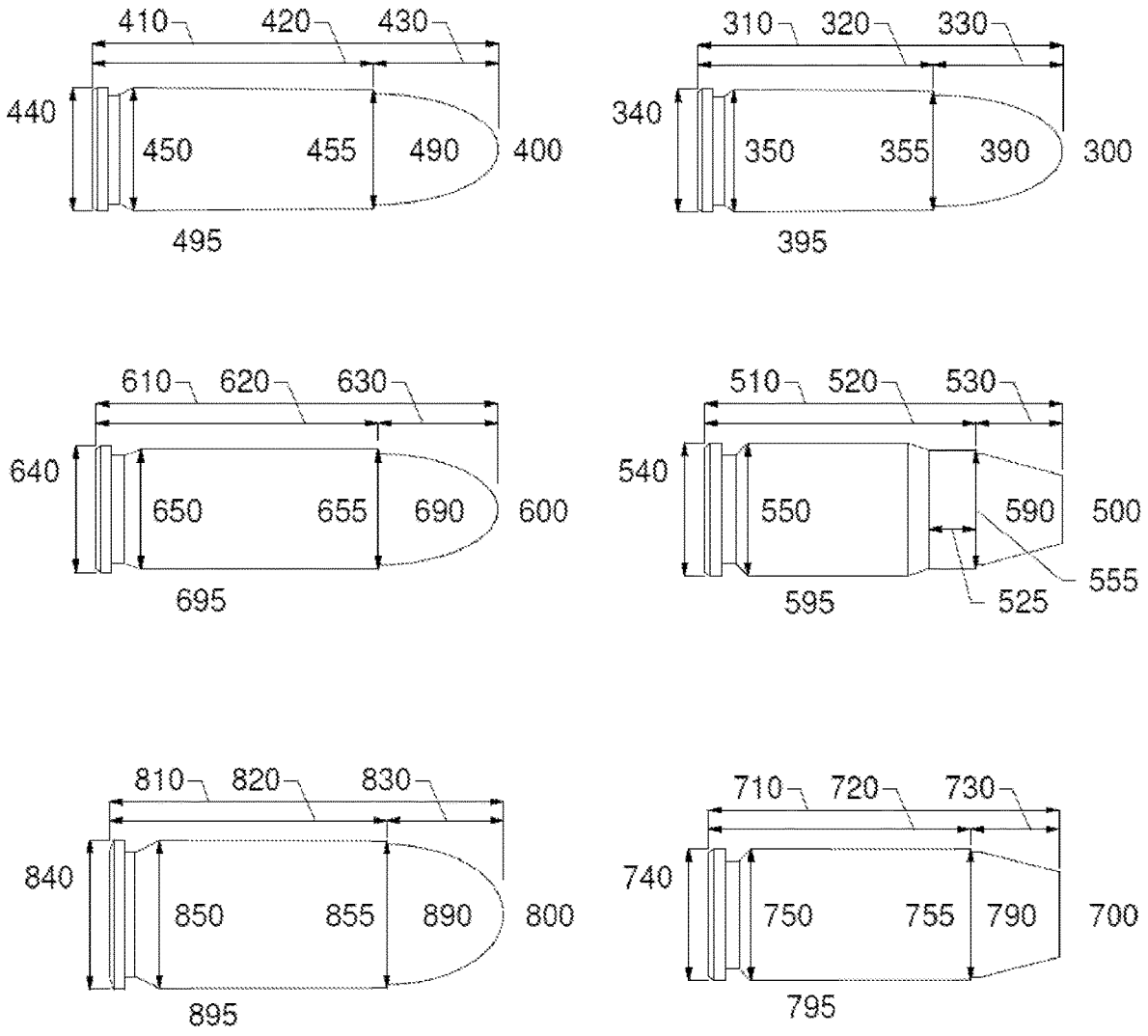
Prior Art FIG. 7
FIG. 7 illustrates two columns of various conventional medium and large pistol cartridges and bullets therein.

FIG. 7 illustrates two columns of various conventional cartridges. Item 100 depicts the 30 SK™ cartridge. Using a method of numerical identification similar to the one described above for the 30 SK™: Items 300 through 395 relate to the 9 mm Luger. Items 500 through 595 relate to the 357 SIG. Items 700 through 795 relate to the 40 S&W. Items 200 through 295 relate to the 30 Super™. Items 400 through 495 relate to the 9×23 mm Winchester. Items 600 through 695 relate to the 38 Super. Items 800 through 895 relate to the 45 ACP.

The following numbers apply to medium frame pistols:

| Cartridge: | 30 SK ™ | 9 mm Luger | 40 S&W | 357 SIG |
|---|---|---|---|---|
| Bullet Diameter | .308" | .355" | .400" | .355" |
| COAL | 1.169" | 1.169" | 1.135" | 1.140" |
| Case Length | .789" | .754" | .850" | .865" |
| Ogive Length | .380" | .415" | .285 | .275" |
| Fineness Ratio (Ogive Length/ Bullet Dia) | 1.234 | 1.169 | .713 | .775 |
| Rim Diameter | .394" | .394" | .424" | .424" |
| Base Diameter | .391" | .391" | .424" | .424" |
| Neck Diameter | .333" | .380" | .423" | .381" |
| Bottleneck Length | .25" | 0 | 0 | .15" |
| Nom. Bullet Weight (grains) | 110 | 124 | 155 | 124 |
| Nom. Bullet Length | .64" | .623" | .600" | .623" |
| Aspect Ratio (bulletlength/dia) | 2.08 | 1.75 | 1.50 | 1.75 |
| Max. Case Pressure (kpsi) | 55 | 35-38.5 | 35 | 40 |

The following numbers apply to large frame pistols:

| Cartridge: | 30 Super ™ | 9 × 23 Win | 38 Super | 45 ACP |
|---|---|---|---|---|
| Bullet Diameter | .308" | .355" | .355" | .452" |
| COAL | 1.280" | 1.300" | 1.280" | 1.275" |
| Case Length | .900" | .900" | .900" | .898" |
| Ogive Length | .380" | .400" | .380" | .377" |
| Fineness Ratio | 1.234 | 1.127 | 1.070 | .834 |
| Rim Diameter | .394" | .394" | .406" | .480" |

-continued

| Cartridge: | 30 Super ™ | 9 × 23 Win | 38 Super | 45 ACP |
|---|---|---|---|---|
| Base Diameter | .391" | .391" | .384" | .476" |
| Neck Diameter | .333" | .381" | .384" | .473" |
| Bottleneck Length | .25" | 0 | 0 | 0 |
| Nom. Bullet Weight (grains) | 110 | 124 | 124 | 230 |
| Nom. Bullet Length | .64" | .623" | .623" | .64" |
| Aspect Ratio | 2.08 | 1.75 | 1.75 | 1.42 |
| Max. Case Pressure (kpsi) | 55 | 55 | 36.5 | 21-23 |

The above dimensional comparisons between the 30 SK™ and 30 Super™ versus other cartridges cited herein reveals significant dimensional and functional differences that result in superior performance by the 30 SK™ and 30 Super™. Case pressure limits obtained from Section 1—Centerfire Pistol and Revolver/SAAMI (Sporting Arms and Ammunition Manufacturers Institute) Voluntary Performance Standards.

Using the 9×23 mm Winchester case with its substantially higher allowable pressure for the bottlenecked 30 SK™ will generate higher muzzle velocity than the 9 mm Luger, 40 S&W and 357 SIG, greater penetration potential than the 9 mm, 40 S&W and 357 SIG due to the higher velocity in conjunction with the smaller cross sectional area, higher expected muzzle energy in comparison with other medium frame cartridges due to the higher allowable case pressure, flatter trajectory and extended effective range due to the higher velocity, greater fineness ratio, greater aspect ratio and smaller bullet diameter. Additionally, the longer bottle neck of the 30 SK™ versus the 357 SIG allows for wider use in pistols and submachine guns that employ direct blowback actions. With the COAL and case diameter being essentially the same as the 9 mm Luger, all of the above listed benefits can be obtained by simply retrofitting existing 9 mm Luger pistols with a new barrel and stronger recoil spring.

Similar benefits redound to the 30 Super™ in comparison to the 38 Super, 9×23 mm Winchester, 10 mm Auto and 45 ACP. The dominant cartridge used in large frame pistols is the 45 ACP. Because of its larger rim and base diameter some additional modifications, other than simply replacing the barrel and recoil spring, may be required.

The 30 Super™ and 30 SK™ are both designed with an ogive length sufficient to utilize 30 caliber bullets used in the 30 Carbine cartridge, renowned from WWII. Current 30 Carbine bullet designs include full metal jacket, soft lead round nose, jacketed hollow point and polymer tipped hollow point bullets. As was the case in WWII with the 30 Carbine, the US military uses full metal jacket projectiles for its 9 mm service pistol.

Although not a signatory to the Hague Declaration, which prohibits expanding or flattening bullets, the US uses the 9 mm Luger/NATO cartridge with full metal, copper jacketed bullets and an elliptical profile. Performance superior to the 9 mm NATO round with enhanced terminal effects, greater penetration against soft body armor, increased accuracy and increased effective range are key features sought in the Modular Handgun System.

Another aspect of this invention discloses new 30 caliber cartridges based on the 10 mm Automatic (10×25 mm) case that have been necked down for 30 caliber bullets (0.308" diameter), resulting in superior external ballistic and terminal performance. The first cartridge will be designated as the 7.62×22 mm and also known as the 30-40 Automatic™. This cartridge is designed to be a drop-in-replacement requiring only a new barrel and recoil spring for larger frame pistols that fire the 10 mm Automatic with a nominal COAL of 1.26".

The second cartridge based on the 10 mm Automatic (10×25 mm) case will be designated as the 7.62×19 mm and also known as the 30-40 AS™. This cartridge is designed to be a drop-in-replacement requiring only a new barrel and recoil spring for medium frame pistols that fire either the 40 S&W or the 357 SIG with a nominal COAL of 1.14". The 30-40 AS™ is essentially a shorter version of the 30-40 Automatic™ with less powder volume underneath the seated bullet.

Figure 8:
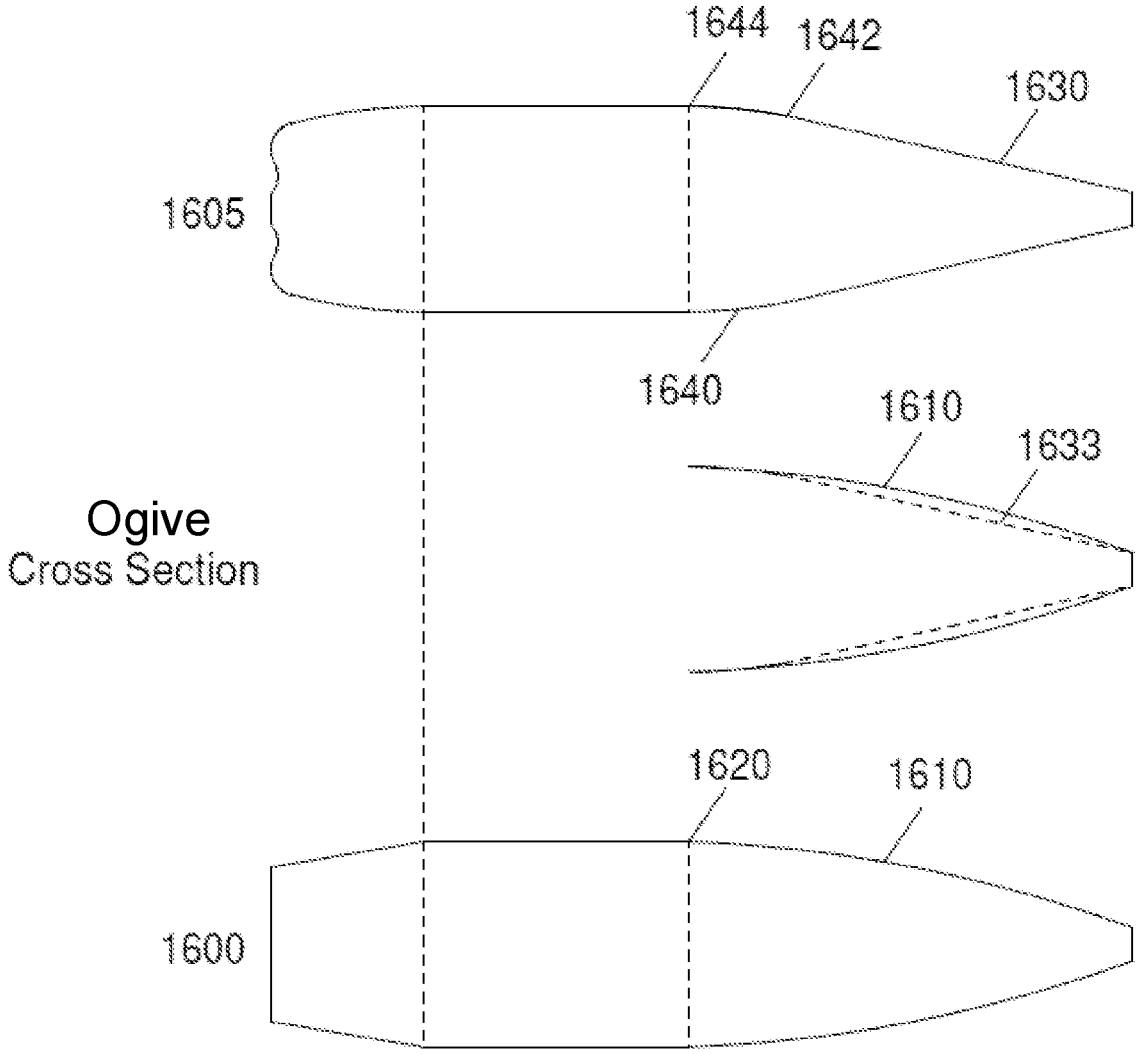
FIG. 8 depicts the shape and size benefits of a bullet with a truncated cone ogive, dual tangent blend radii and dimpled base in comparison to a secant ogive in accordance with an embodiment of the present disclosure.
Figure 9:
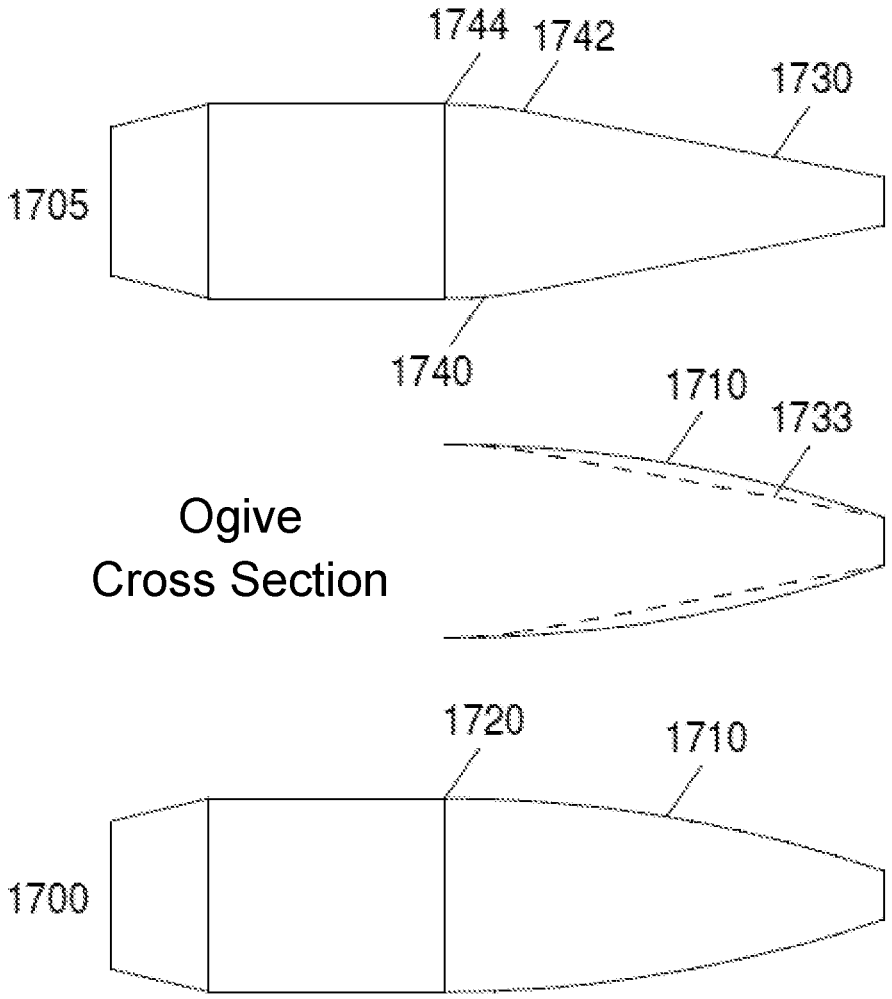
FIG. 9 depicts a second example of the shape and size benefits of an improved bullet in comparison to a tangent ogive in accordance with an embodiment of the present disclosure.

FIGS. 8 and 9 illustrate the shape and size benefits of a bullet with a truncated cone ogive and a dual tangent blend radius in comparison to a secant ogive and a tangent ogive in accordance with an embodiment of the present disclosure. The 7.62 mm (0.308") diameter conventional rifle bullet shapes found in FIG. 8 (M118 Match with secant ogive) and FIG. 9 (Sierra International M852 with tangent ogive) were obtained at pages 11 and 13 respectively from *Aerodynamic Characteristics of* 7.62 *mm Match Bullets*, December 1988 by Robert L. McCoy of the Ballistic Research Laboratory, Aberdeen Proving Grounds, Md.

As also drawn in FIGS. 8 and 9, the radius of curvature for Item 1640 and Item 1740 are both 2.5 caliber or 0.77". This results in the cone diameter at Item 1642 and Item 1742 both being smaller than the inside diameter of the rifle lands. For a rifle that fires 0.308" diameter bullets the grooves of the rifling are nominally 0.308" and the lands of the rifling are nominally 0.300".

Item 1600 in FIG. 8 is a profile view of the M118 Match bullet in 0.308" caliber. Item 1610 is the ogive profile. Item 1620 is the non-tangent intersection of Item 1610 with shank of the bullet, Item 1600. Item 1605 has the same ogive length, shank length and overall length as Item 1600. Item 1630, is a truncated cone with dual tangent blend radius. Item 1640 is the blend radius between the truncated cone portion and the shank of Item 1605. Item 1642 is the tangent intersection point of the truncated cone and the blend radius, Item 1640. Item 1644 is the tangent intersection point of the blend radius, Item 1640, with the shank of the bullet. Item 1633 is the same as Item 1630 but shown in dashed lines and overlaying an extracted Item 1610.

Item 1700 in FIG. 9 is a profile view of the Sierra International M852 bullet in 0.308" caliber. Item 1710 is the ogive profile. Item 1720 is the tangent intersection of Item 1710 with shank of the bullet, Item 1700. Item 1705 is the same as Item 1700 except the ogive, Item 1730, is a truncated cone with dual tangent blend radius. Item 1740 is the blend radius between the truncated cone portion and the shank of Item 1705. Item 1742 is the tangent intersection point of the truncated cone and the blend radius, Item 1740. Item 1744 is the tangent intersection point of the blend radius, Item 1740, with the shank of the bullet. Item 1733 is the same as Item 1730 but shown in dashed lines and overlaying an extracted Item 1710.

Figure 10:
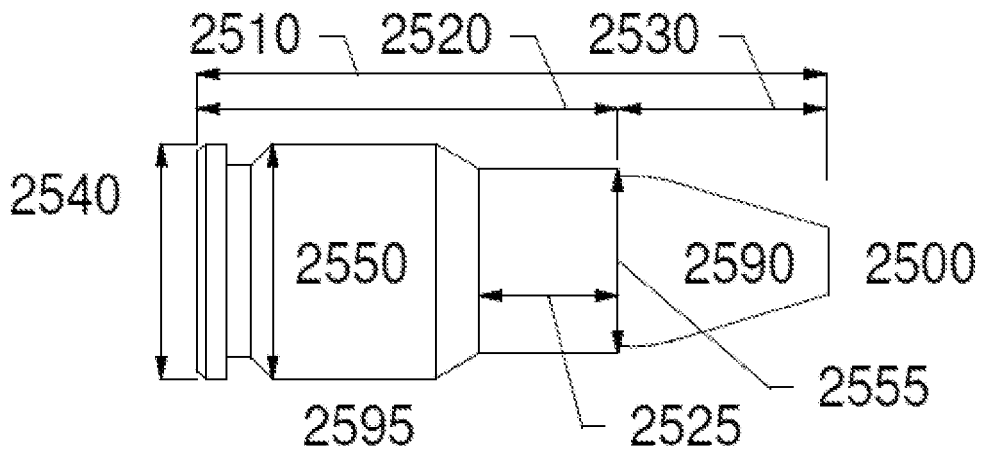
FIG. 10 depicts two exemplary pistol cartridges and respective improved pistol bullets therein in accordance with an embodiment of the present disclosure.
Figure 10:
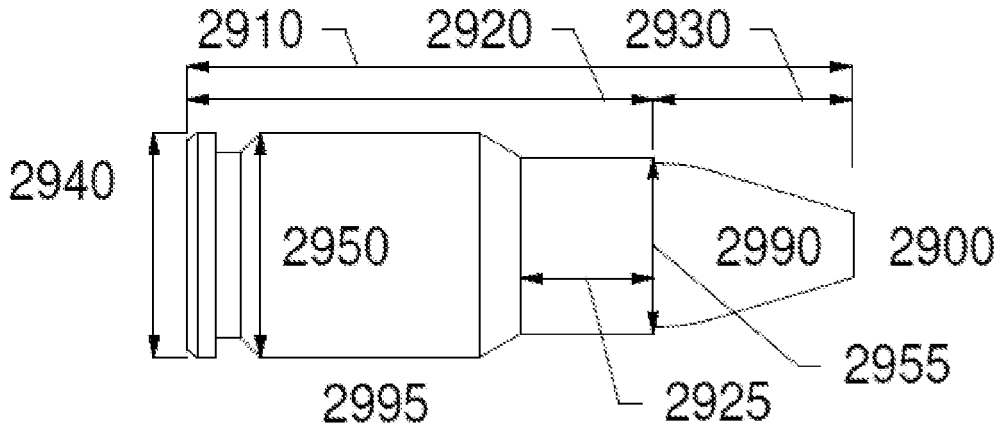

FIG. 10 depicts two exemplary pistol cartridges and respective improved pistol bullets therein in accordance with an embodiment of the present disclosure. Specific dimensions for reference numbers shown with respect to items 2500 and 2900 may be found in respective drawings of FIG. 11. Item 2500 depicts the 30-40 AS™ cartridge. Item 2510 indicates the COAL for the 30-40 AS™. Item 2520 indicates the Case Length for the 30-40 AS™. Item 2525 indicates the Bottleneck Length for the 30-40 AS™. Item 2530 indicates the Ogive Length for the 30-40 AS™. Item 2540 indicates the Rim Diameter for the 30-40 AS™. Item 2550 indicates the Base Diameter for the 30-40 AS™. Item 2555 indicates the Neck Diameter for the 30-40 AS™. Item 2590 indicates the bullet loaded in the 30-40 AS™. Item 2595 indicates the brass case that contains the primer, gun powder (not shown) and bullet, Item 2590, within.

Using a method of identification similar to the one described above for the 30-40 AS™: Items 500 through 595 relate to the 357 SIG. Items 700 through 795 relate to the 40 S&W. Items 2900 through 2995 relate to the 30-40 Automatic™. Items 900 through 995 relate to the 10 mm Automatic.

The following numbers apply to Medium Frame Pistols:

| Cartridge: | 30-40 AS | 40 S & W | 357 SIG |
|---|---|---|---|
| Bullet Diameter | .308" | .400" | .355" |
| COAL | 1.140" | 1.135" | 1.140" |
| Case Length | .760" | .850" | .865" |
| Ogive Length | .380" | .285 | .275" |
| Fineness Ratio | 1.234 | .713 | .775 |
| Rim Diameter | .424" | .424" | .424" |
| Base Diameter | .424" | .424" | .424" |
| Neck Diameter | .333" | .423" | .381" |
| Bottleneck Length | .25" | 0 | .15" |
| Nominal Bullet Weight (grains) | 110 | 155 | 124 |
| Nominal Bullet Length | .64" | .600" | .623" |
| Aspect Ratio | 2.08 | 1.50 | 1.75 |
| Max. Case Pressure (kpsi) | 40 | 35 | 40 |

The following numbers apply to Large Frame Pistols:

| Cartridge: | 30-40 Auto | 10 mm Auto |
|---|---|---|
| Bullet Diameter | .308" | .400" |
| COAL | 1.260" | 1.260" |
| Case Length | .880" | .992" |
| Ogive Length | .380" | .268" |
| Fineness Ratio | 1.234 | .670 |
| Rim Diameter | .424" | .424" |
| Base Diameter | .424" | .424" |
| Neck Diameter | .333" | .423" |
| Bottleneck Length | .25" | 0 |
| Nominal Bullet Weight (grains) | 110 | 180 |
| Nominal Bullet Length | .64" | .660" |
| Aspect Ratio | 2.08 | 1.65 |
| Max. Case Pressure (kpsi) | 40 | 37.5 |

The above dimensional comparisons between the 30-40 AS™ and 30-40 Automatic™ versus other cartridges based on the 10 mm Automatic case reveal significant dimensional and functional differences that result in superior performance by the 30-40 AS™ and 30-40 Automatic™. The 0.394" rim diameter of the 9×23 mm Winchester case is sufficiently different than the 0.424" rim diameter of 10 mm Automatic case as to cause new cartridge feeding and spent cartridge extraction problems, if the 30 Super™/30 SK™ cartridges were retrofitted for use in weapons designed for 10 mm Automatic, 40 S&W and 357 Sig cartridges. Otherwise, many of the ballistic and functional benefits of the 30 Super™/30 SK™ cartridges will be evident in 30-40 Automatic/30-40 AS cartridges as well.

Figure 11:
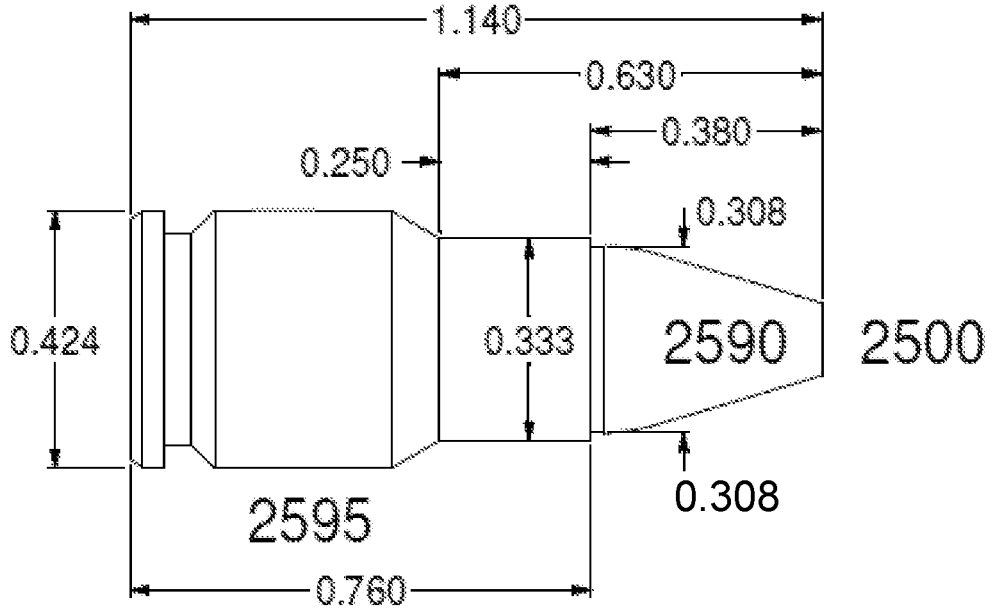
FIG. 11 depicts the dimensions of 2 exemplary pistol cartridges and respective pistol bullets therein in accordance with an embodiment of the present disclosure.
Figure 11:
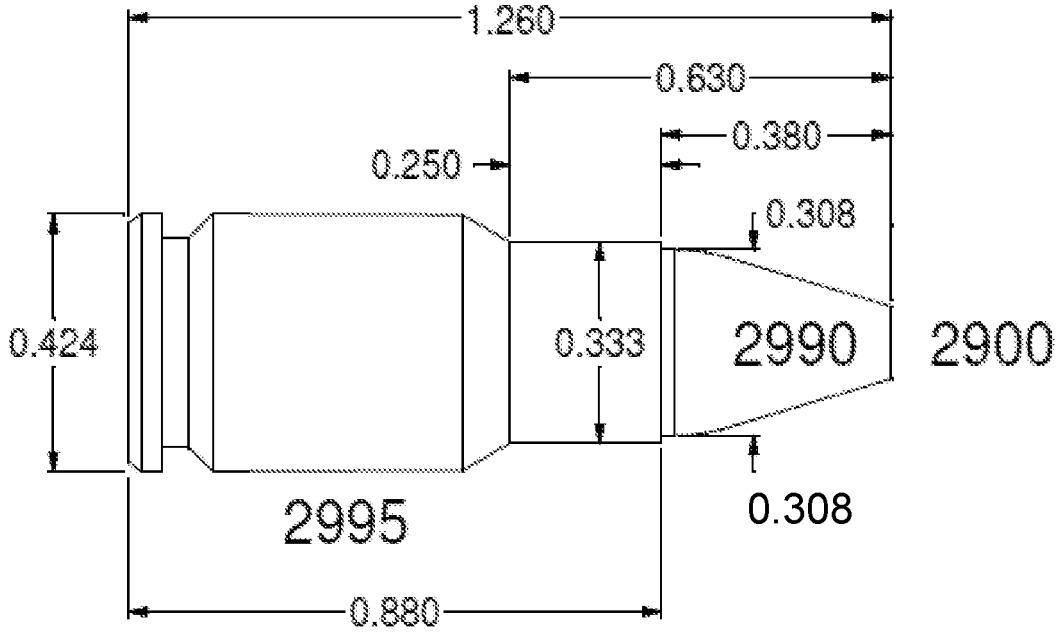

FIG. 11 depicts the specific dimensions of 2 exemplary pistol cartridges and respective pistol bullets therein in accordance with an embodiment of the present disclosure. Dimensions shown are in inches. Some reference numbers shown are the same or similar to reference numbers used in FIG. 10 and elsewhere herein.

This application details novel individual improvements and additional benefits in combining improvements in a firearm and ammunition system. The disclosed firearm barrel and chamber design improve the interaction of firearm projectiles with the barrel as it moves from the cartridge, including firearm projectiles, firearm cartridges and firearm suppressors.

From the SAAMI (Sporting Arms and Ammunition Manufacturers' Institute) Glossary the following definitions are used in this application and cited herein by implicit reference:

FREE BORE: A cylindrical length of bore in a firearm just forward of the chamber in which rifling is not present. Associated with bullet jump.

LEADE (LEAD): That section of the bore of a rifled gun barrel located immediately ahead of the chamber in which the rifling is conically removed to provide clearance for the seated bullet. Also called Throat or Ball Seat.

THROAT: See Leade (Lead).

Figure 12:
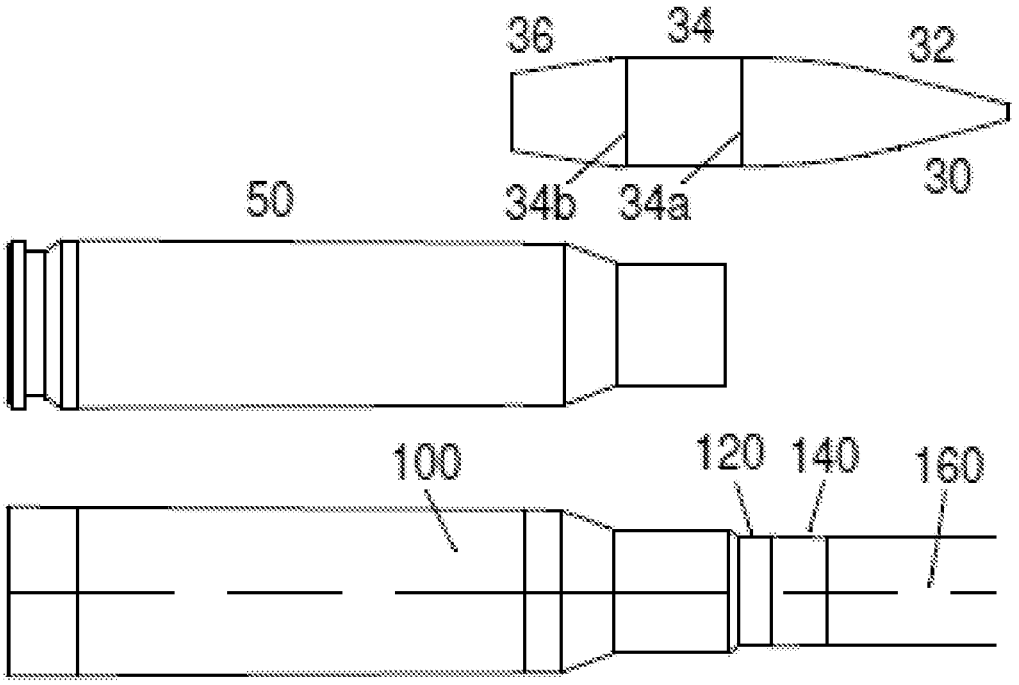
FIG. 12 illustrates a typical cartridge case 50, projectile 30 and chamber 100 for a common rifle cartridge, which in FIG. 12 is the 308 Winchester according to an embodiment of the present disclosure.

CHAMBER:

1. In a rifle, shotgun or pistol, the rearmost part of the barrel that has been formed to accept a specific cartridge or shell when inserted 2. In a revolver, the holes in the cylinder that have been formed to accept a cartridge FIG. 12 illustrates a typical cartridge case 50, projectile 30 and chamber 100 for a common rifle cartridge, which in FIG. 12 is the 308 Winchester according to an embodiment of the present disclosure. As found on the SAAMI web site, the chamber freebore 120 for the 308 Winchester has a length of 0.090" and internal diameter of 0.310". The chamber leade 140 has a cone angle of 1 degree, 45 minutes relative the bore centerline 160. FIG. 12 also illustrates projectile 30 with ogive 32, bearing or shank section 34 and boattail 36. The caliber or diameter 34*a* of the projectile 30 is same at the end of the ogive 32 and beginning of the boattail 36.

Figure 13:
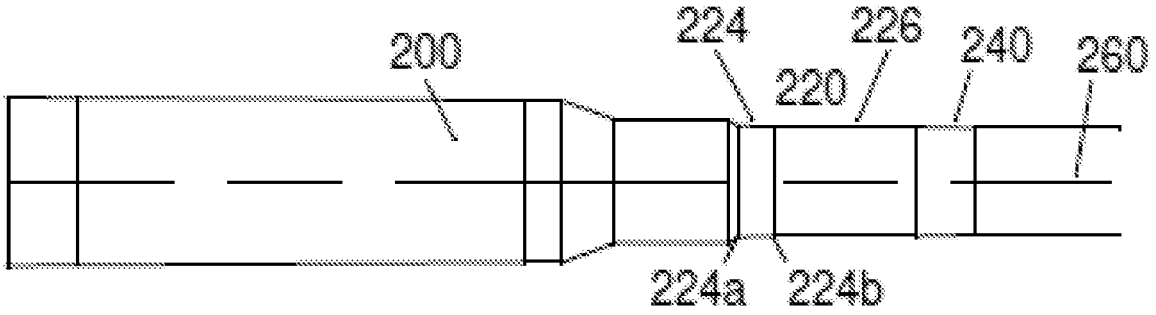
FIG. 13 illustrates chamber 200 which is similar to chamber 100 and is sized to receive the same 308 Winchester cartridge case 50 in this exemplary depiction in accordance with an embodiment of the disclosure.

FIG. 13 illustrates chamber 200 which is similar to chamber 100 and is sized to receive the same 308 Winchester cartridge case 50 in this examplary depiction in accordance with an embodiment of the disclosure Chamber 200 has a compound freebore 220 comprised of a conical first section 224 and cylindrical second section 226, neither of which have any rifling. The entry diameter 224*a* of the first section 224 is slightly wider than the exit diameter 224*b*. Exit diameter 224*b* is the same diameter has found in the cylindrical second section 226 of the freebore 220.

In the FIG. 13 example the overall length of the compound freebore 220 in this improved firearm chamber would be equal to or greater than the nominal projectile diameter or caliber. The bore length of the first section 224 would be equal to or less than half the overall length of freebore 220. The first section 224 of the compound freebore has a slight conical taper that ends 224*b* coincident with the beginning of the cylindrical second part 226. Although not illustrated, the conical first section 224 of the compound freebore 220 could be comprised of more than one conical section or a curved profile.

Generally stated, the dimensions of the freebore 220 are such that as bullet 30 moves away from the cartridge case, the leading edge of the bullet shank, 34*a*, enters the cylindrical second section 226 of the compound freebore 220 before the trailing edge of the bullet shank 34*b* exits the cartridge mouth. As the bullet 30 continues moving from the case, trailing edge of the bullet shank 34*b* leaves the case before the leading edge 34*a* or the ogive makes contact with the leade 240 of the barrel or rifling 260.

Figure 14:
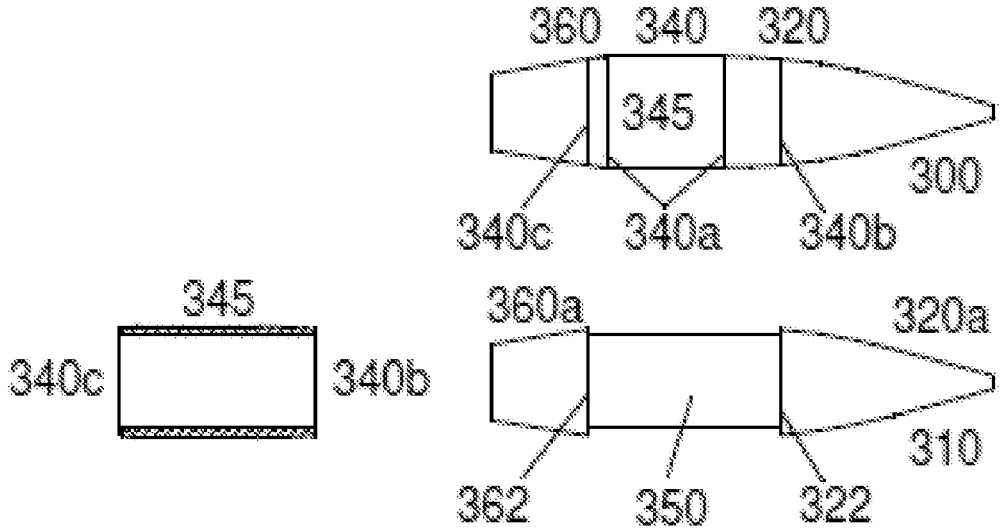
FIG. 14 illustrates projectile 300 which is sized for 308 Winchester as is projectile 30 in FIG. 12 in accordance with an embodiment of the disclosure.

FIG. 14 illustrates projectile 300 which is sized for 308 Winchester as is projectile 30 in FIG. 12 in accordance with an embodiment of the disclosure. Projectile 300 has a similar profile as projectile 30 with certain differences described as follows. The projectile 300 has ogive 320, shank 340 and boattail 360. Projectile 300 would have a core 310 and sheath or jacket or sleeve 345, which includes a trailing portion of the ogive 320 commencing at 340*b* and a leading portion of the boattail 360 ending at 340*c*. Sheath or jacket or sleeve 345 would be comprised of a polymer material molded or affixed around the primary core 310. Primary core 310 as illustrated would be monolithic metal, such as but not limited to brass, lead, copper, titanium, steel or tungsten, and manufactured similar to a profile as seen in FIG. 14 comprising the primary core reduced diameter 350, also known as a shank waist.

The exterior surface of sheath or jacket or sleeve 345 encompasses the shank 340 of projectile 300. Sheath or jacket or sleeve 345 would fill the reduced diameter 350 or shank waist of primary core 310 to complete and annularly fill out the projectile 300. The trailing edge 322 of ogive 320*a* would coincide with the leading edge 340*b* of sheath or jacket 345. The leading edge 362 of boattail 360*a* would coincide with the trailing edge 340*c* of sheath or jacket or sleeve 345.

Diameter 340*a* of projectile 300 would be slightly bigger than diameter 34*a* of projectile 30. Diameter 340*a* would be slightly less than the leading diameter 224*a* of FIG. 13 and slightly more than trailing diameter 224*b* of the first section 224 of compound freebore 220 also of FIG. 13. The preferred material for sheath or jacket or sleeve 340 is a polymer material as described herein but not limited thereto.

Said polymer sheath or jacket or sleeve would be relatively thin to maximize the weight of the projectile 300 derived predominantly from the core 310. Dimensions and material thicknesses of the sleeve would be such to prevent any portion of projectile core 310 from contacting the interior of the freebore 220, the leade 224 or the rifling and bore of the barrel.

Diameter of the sleeve 340*a* would be equal to or slightly greater than the minimum diameter of freebore 220. Movement of the projectile 300 through the freebore 220 would effectively center the projectile 300 relative to the freebore 220 and rifle bore 260 accordingly as it moves towards the leade 240 and then moves into the rifled portion of the barrel. Centering the projectile relative to the bore 260 improves accuracy by eliminating or minimizing axial misalignment between the projectile and barrel bore.

Diameter of the sleeve 340*a* would be equal to or slightly greater than the bore of the rifle barrel to maintain concentricity of projectile as it moves down the barrel and better seal propellant gases pushing the projectile 300. Complete gas seal can increase muzzle velocity by improving energy transferred by the expanding gases. Polymer material composition of the attached sleeve would have less friction than copper or brass jacket material. Consequently, projectile velocity would increase for the same weight projectile. Wear on the rifling of the barrel would be reduced and heat transferred to the barrel would be reduced. Cooler barrels are more stiff than hotter barrels of the same size and cooler barrels are more accurate. Cooler barrels allow for increased sustained rates of fire, rounds per unit of time.

Molded polymer material shrinks when it cools and would firmly attach the sleeve 345 to the core 310 in a molding operation where the core 310 is an insert and the jacket 345 is molded around it. As the projectile moves down the barrel at high velocity, the shrinkage of the plastic sleeve to the core prevents the sleeve from peeling off or slipping as the projectile is rotated by the rifling of the barrel.

Figure 15:
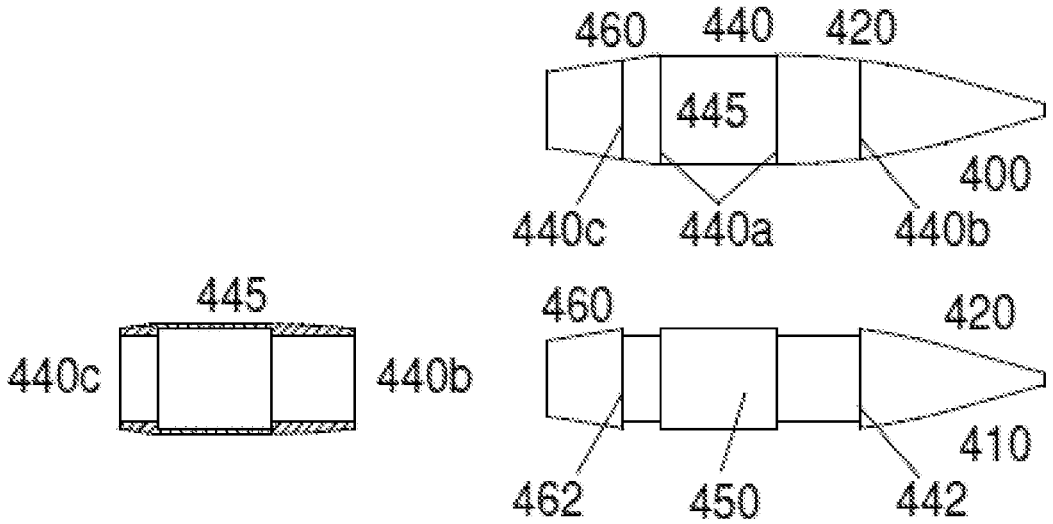
FIG. 15 is a double waisted shank projectile in accordance with an embodiment of the present disclosure.

FIG. 15 is a double waisted shank projectile in accordance with an embodiment of the present disclosure. Projectile 400 as seen in FIG. 15 is a different execution but similar to projectile 300. Projectile 400 would result in a sleeve with the same exterior dimensions, profile, relationships and improvements described herein above for projectile 300. Constructed as herein described, projectile 400 allows for less expensive and different core materials like steel without employing an expensive copper jacket. Improvements described herein for smaller caliber rifle projectiles apply generally for handguns and larger caliber firearms such as artillery shells without limitation. The double waist shank improves a seal of the sleeve around the shank and improves a seal of the projectile in the freebore 220 of FIG. 13.

Figure 16:
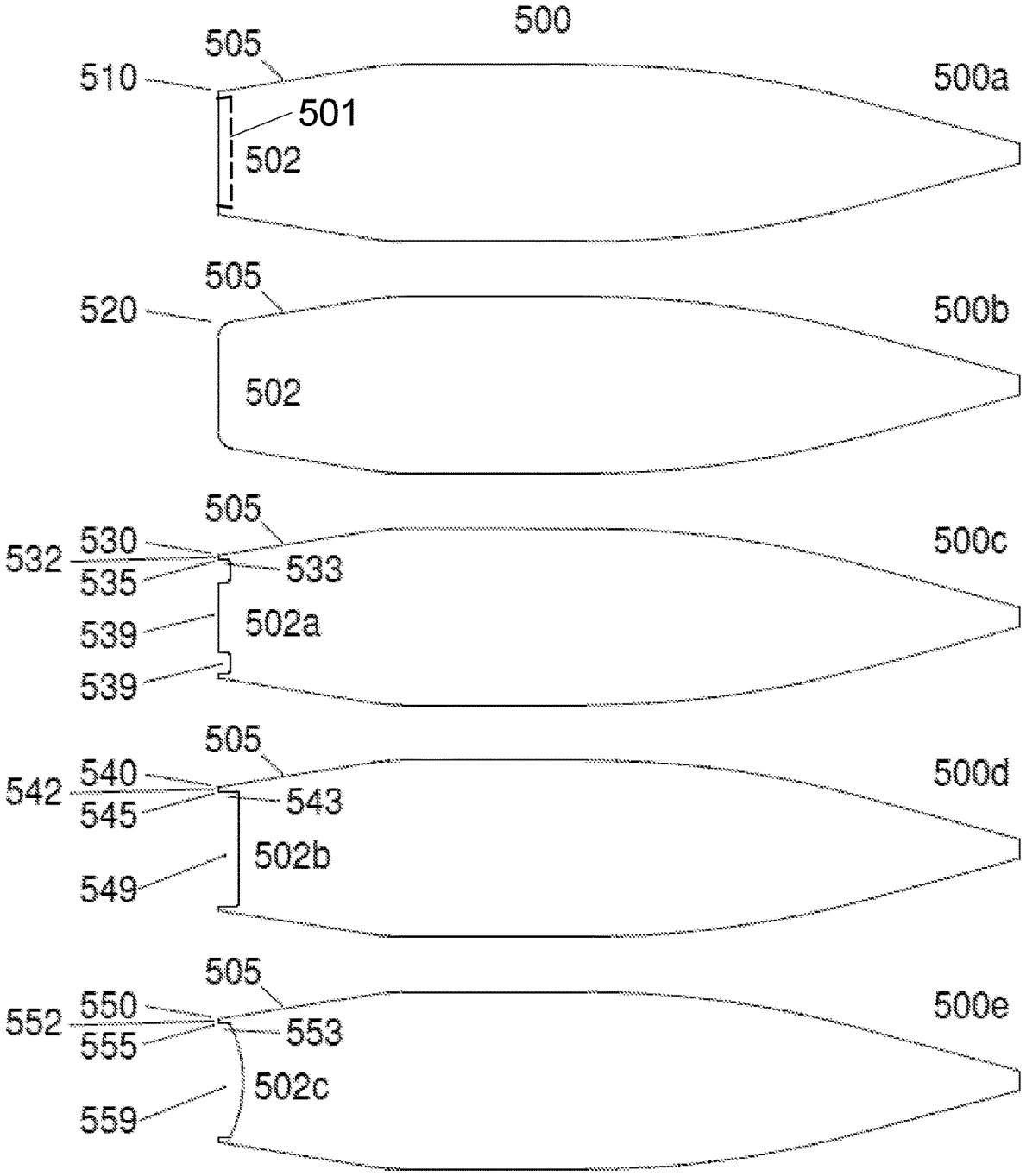
FIG. 16 illustrates different versions of bullet 500 which has a tapered boattail 505 at the back end of the bullet in accordance with an embodiment of the present disclosure.

FIG. 16 illustrates different versions of bullet 500 which has a tapered boattail 505 at the back end of the bullet in accordance with an embodiment of the present disclosure. Boattail 505 has a fixed angle of approximately 18 degrees. A boattail angle of greater than 18 degrees can cause the slipstream air to separate its engagement with the boattail surface before reaching the bullet base and cause increased wake turbulence and corresponding aerodynamic drag.

As seen in FIG. 16, version 500*a* includes boattail 505 that intersects with the bullet base 502 at a sharp edge 510. Version 500*b* includes boattail 505 that has a gradual radius intersection edge 520 with the bullet base 502.

As further seen in FIG. 16, version 500*c* includes boattail 505 that intersects with the bullet base 502*a* at a sharp edge 530. A small, flat segment 532 or plateau of the bullet base 502*a* is indicated between sharp edge 530 and additional sharp edge 535. Annular trough or annular dimple 533 would be machined or generated continuously on bullet base 502*a*. Annular trough 533 provides localized space and a low pressure zone to influence the slipstream to more completely flow around the bullet base and reduce wake turbulence drag. Different than moving across the bullet ogive, when the slipstream is in relative movement parallel to the bullet shank or slighty away from the bullet along the boattail surface, a sharp angle edge can induce abrupt pressure drop and change the flow direction of the slip stream. Gradual sharp angle transitions beyond 18 degrees included angle or radius intersection of the boattail and bullet base can cause the slip stream to separate prematurely, increasing the wake turbulence zone and corresponding drag.

Version 500*d* is similar to version 500*c* with a cylindrical counter bore 549 across the entire bullet base instead of the annular trough 539. The sharp edges 540 and 535 are separated by the transitional flat segment or annular plateau 542. Version 500*e* is similar to version 500*d* with a concave counter bore 559 across the entire bullet base instead of a cylindrical counter bore 549 or an annular trough 539. The sharp edges 550 and 555 are separated by the transitional flat segment or annular plateau 552.

The depression in the base of the bullet is separated by the boattail of the bullet by respective annular plateaus 532, 542 and 552 having a first sharp edge less than 90 degrees from the boattail to the annular plateau and a second sharp edge greater than or equal to 90 degrees undercut from the annular plateau to the depression. An undercut depression 501 is depicted in 500*a* by broken lines showing an angle less than 90 degrees from the annular plateau to the depression in the base 502 of the bullet 500.

Generally speaking, flow characteristics of the slipstream along a projectile boattail are independent of bullet caliber. Consequently, reduction in wake turbulence by the described methods benefit smaller caliber projectiles such as 0.224", 0.264" and 0.308" to a greater degree than larger caliber projectiles like 0.510" caliber and greater.

Base bleed or hot gas generators can be found on back ends of large artillery shells. These function not as rocket motors to generate thrust but to fill the low pressure, wake turbulence zone just aft of the artillery shell. Base bleed systems on artillery shells can increase the firing range by as much as 30% for a small reduction in explosive payload.

Market success of a new caliber for modern rifles depends on many variables. Among the most influential are the Cartridge Over All Length, COAL, of existing popular cartridges. The .223 Remington and .308 Winchester are two of the most popular rifle calibers, with 2.26" COAL and 2.81" COAL respectively. A relatively new caliber known as 300 Blackout, 7.62×35 mm, fires a 0.308" diameter bullet fitted to a shortened and slightly necked out 0.223 Remington case. 300 Blackout has a COAL essentially the same as .223 Remington. Another relatively new caliber known as 6.5 Creedmoor, 6.5×49 mm, fires a 0.264" diameter bullet fitted to a shortened and necked down .308 Winchester case. It has a COAL essentially the same as .308 Winchester. The economic and market benefits for any new caliber to utilize existing cartridge cases and COALs cannot be overstated.

Described in this application are two new calibers that meet emerging requirements for next generation automatic rifles, carbines and light machine guns sought by the military but are equally useful in the civilian market. Both cartridges are based on the 0.223 Remington case and utilize the unique chamber design, plastic sleeved projectile and wake turbulence reducing features described previously.

Figure 17:
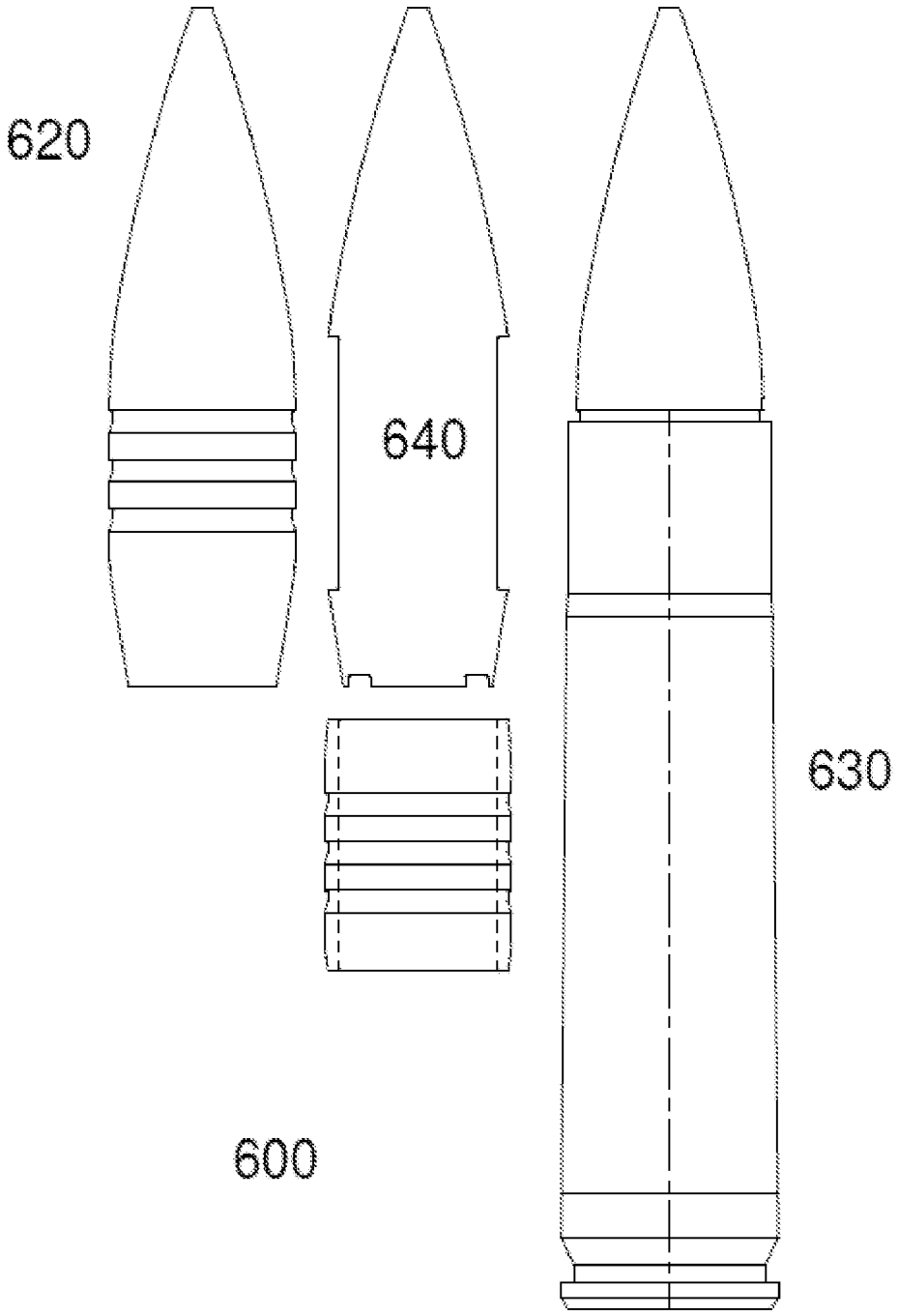
FIG. 17 illustrates a nominally straight wall cartridge 600, known as the Straight 8 or 8 mm AR with a base annular trough, a sleeve-waisted shank and an extended freebore in accordance with an embodiment of the present disclosure.

FIG. 17 illustrates a nominally straight wall cartridge 600, known as the Straight 8 or 8 mm AR with a base annular trough, a sleeve-waisted shank and an extended freebore in accordance with an embodiment of the present disclosure. The Straight 8 depicted includes a nominal 1.54" length, has an 8 mm or 0.323" diameter projectile 620 fitted to a shortened and necked out 0.223 Remington case 630 with a nominal COAL of 2.26". Using this cartridge in existing weapons, like the AR15, M4, M16 and others designed around the 0.223 Remington case, would only require a change of the barrel. The Straight 8 anticipates using the extended freebore features described above and illustrated in FIGS. 12 and 13. The extended freebore allows for use of more energy dense and faster burning propellant powders without exceeding safety limits for barrel breech pressure. This combination of features would result in increased muzzle velocity and muzzle energy above current cartridges based on the 0.223 Remington case. Utilizing a plastic sleeved 8 mm projectile in the Straight 8 reduces bullet to barrel friction, further increasing muzzle velocity and muzzle energy. This application anticipates the steel core 640 of plastic sleeved projectiles to be treated with surface coatings such as melonite, nitrocarburizing, nickel-boron and others to better defeat advanced body armor without using expensive tungsten currently needed to defeat advanced body armor.

Figure 18:
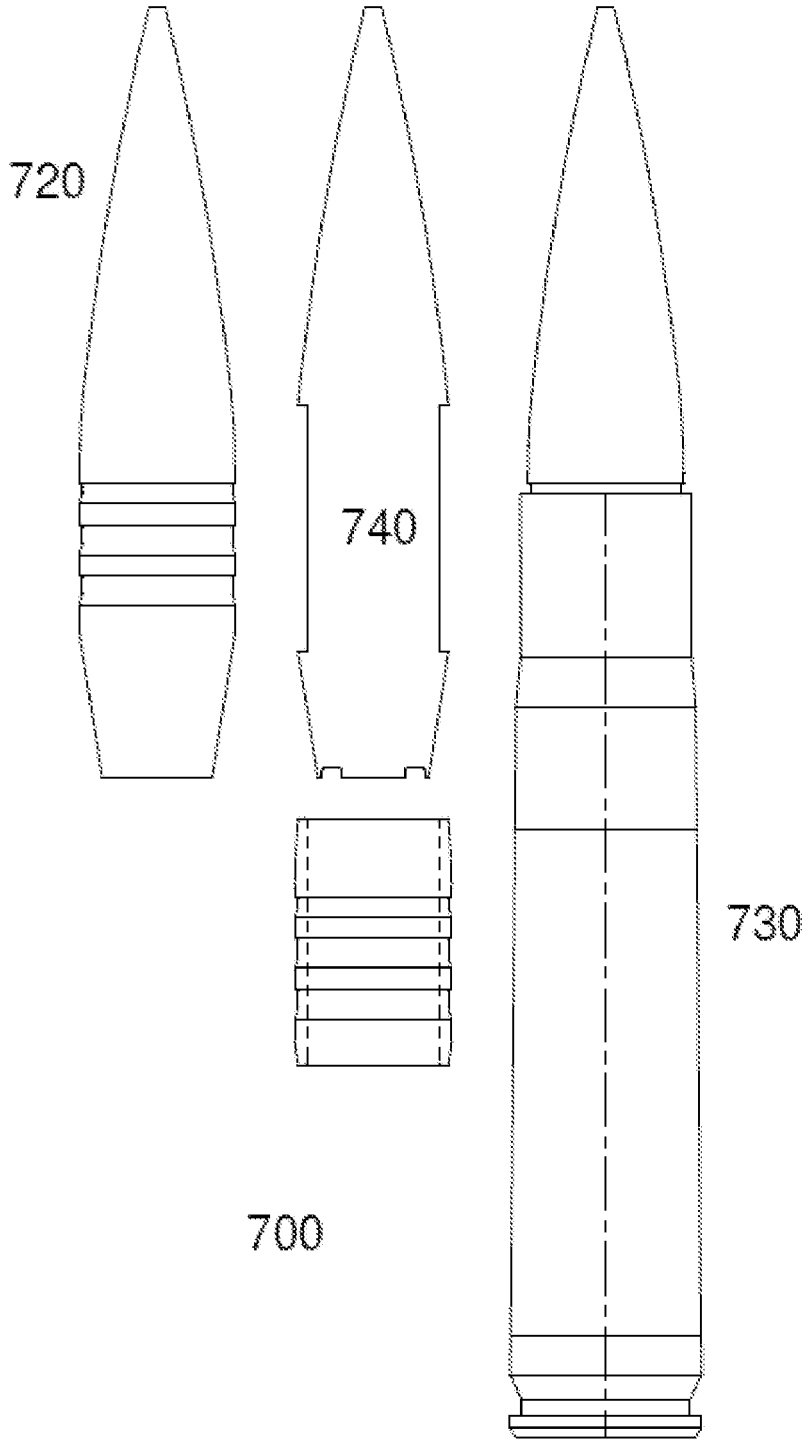
FIG. 18 illustrates a nominally straight wall cartridge 700, known as the Straight 308 with a base annular trough, a sleeve-waisted shank and an extended freebore in accordance with an embodiment of the present disclosure.

FIG. 18 illustrates a nominally straight wall cartridge 700, known as the Straight 308 with a base annular trough, a sleeve-waisted shank and an extended freebore in accordance with an embodiment of the present disclosure. The Straight 308 depicted includes a nominal 1.86" length, has an 7.62 mm or 0.308" diameter projectile 720 fitted to a lengthened and necked out 0.223 Remington case 730 with a nominal COAL of 2.81". Using this cartridge in existing weapons, like the AR10, M110, bolt action rifles chambered for the .308 Winchester and others, would only require a change of the barrel and bolt face. The Straight 308 anticipates using the extended freebore features described above and illustrated in FIGS. 12 and 13. The extended freebore allows for use of more energy dense and faster burning propellant powders without exceeding safety limits for barrel breech pressure. This combination of features plus the additional case length results in increased muzzle velocity and muzzle energy meeting or exceeding current cartridges based on the .308 Winchester case. Utilizing a plastic sleeved 0.308" projectile in the Straight 308 also reduces bullet to barrel friction, further increasing muzzle velocity and muzzle energy.

This application anticipates the steel core 740 of plastic sleeved projectiles to be treated with surface coatings such as melonite, nitrocarburizing, nickel-boron and others to better defeat advanced body armor without using expensive tungsten currently needed to defeat advanced body armor. The smaller diameter .223 Remington case and shorter case length of the Straight 308 reduces loaded cartridge weight when compared to .308 Winchester when loaded with the same weight 0.308" projectile. The 1.86" case length allows for projectiles with longer ogives and reduced drag versus projectiles fired from the 2.015" case length of .308 Winchester.

Figure 19:
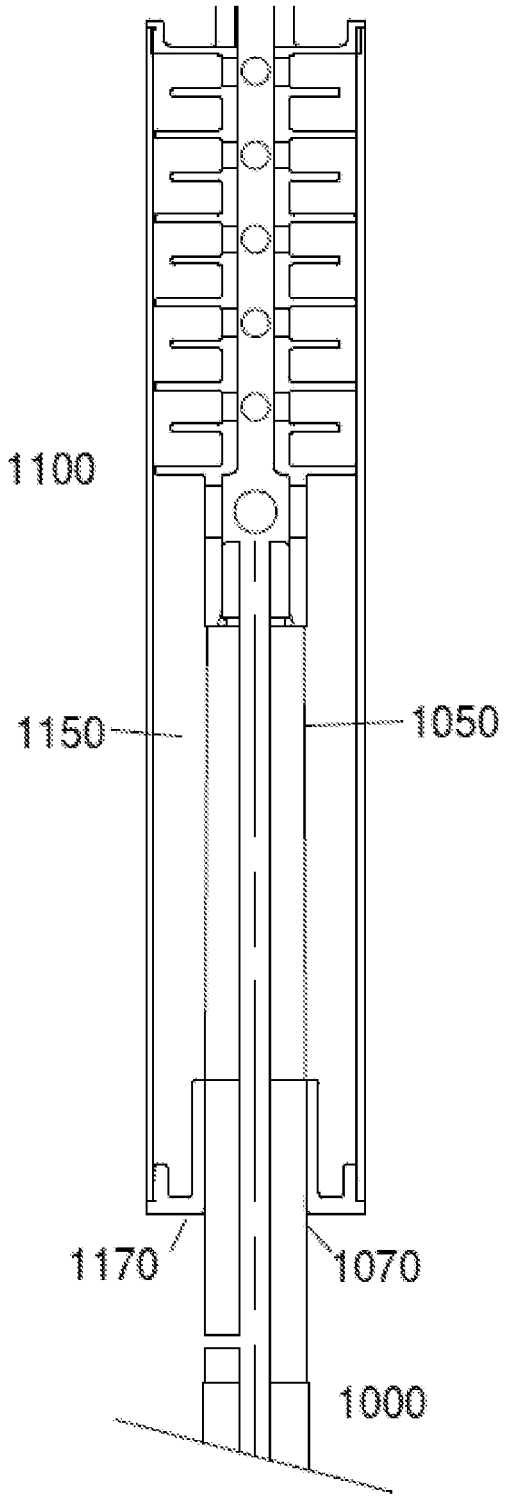
FIG. 19 illustrates a cross section view of an over-the-barrel suppressors mounted to an AR15 barrel 1000 in accordance with an embodiment of the present disclosure.

FIG. 19 illustrates a cross section view of an over-the-barrel suppressors mounted to an AR15 barrel 1000 in accordance with an embodiment of the present disclosure. Over the barrel suppressors have been generally available for decades. The advantages of this design include reduced added length beyond the muzzle, superior suppression of sound, muzzle flash and gas blow back into the chamber. The suppressor blast chamber that extends back toward to the rifle chamber is a key feature. Previous versions utilize an interior tube that slides back over the rifle barrel proper. This interior tube adds weight and reduces interior volume but is necessary to fit different barrel shapes of existing rifles. Suppressor 1100 does not have an interior tube but uses the exterior surface 1050 of barrel 1000 as the surface of the suppressor blast chamber 1150. Assuming the same suppressor tube OD and wall thickness, not having the interior tube results in greater blast chamber volume for the same over-the-barrel length, reduced weight by eliminating the interior tube, shorter over-the-barrel length for the same blast chamber volume, reduced material cost and reduced manufacturing complexity.

Suppressor 1100 uses bushing 1170 attached or welded at the tube end closest to the rifle chamber. Barrel 1000 includes a precision machined journal portion 1070 with an OD slightly less than the ID of bushing 1170. The length of engagement and dimensional clearance between the suppressor bushing 1170 and the barrel journal 1070 is sufficient to check the flow of high pressure gases that exit the muzzle and explosively fill the blast chamber. The portion of the barrel adjacent to the muzzle and the over-the-barrel portion of the suppressor are designed to function one with the other. Attaching the suppressor onto a rifle that did not have the matching interface dimensions would render it non-functional. The above described suppressor and rifle barrel relationships can be applied to bolt action barrels and other firearms as well.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. An improved bullet for a freebore and a rifle barrel of a firearm, the improved bullet comprising:

a bullet shank having at least one reduced diameter waist between an ogive and a boattail of the bullet;

a sleeve adapted to fill out the at least one reduced diameter waist so that a diameter of the sleeve over the shank waist is equal to or slightly greater than a minimum diameter of the firearm freebore and slightly greater than a bore of the rifle barrel; and at least one depression in a base of the bullet, wherein the waisted sleeve and the depression are configured to extend an effective flight range and a Coanda effect there around reducing air turbulence and drag on the bullet in flight.

2. The improved bullet of claim 1, wherein the depression in the base of the bullet comprises a cylindrical counter bore and a concave counterbore.

3. The improved bullet of claim of claim 1, wherein the depression in the base of the bullet is separated by the boattail of the bullet by an annular plateau having a first sharp edge less than 90 degrees from the boattail to the annular plateau and a second sharp edge greater than or equal to 90 degrees undercut from the annular plateau to the depression.

4. The improved bullet of claim 1, wherein the depression in the base of the bullet comprises at least one annular dimple and a plateau center portion of the base lying in a plane intersecting the center points of the annular dimple and orthogonal to a central axis of the bullet.

5. The improved bullet of claim 1, further comprising a double waist shank configured to improve a seal of the sleeve around the shank and improve a seal of the projectile in the firearm freebore.

6. The improved bullet of claim 1, further comprising a multiple waist shank at multiple lateral locations along the shank with at least one unreduced diameter portion there between and a complementary sleeve having a reduced thickness over the unreduced diameter portion.

7. The improved bullet of claim 1, wherein a trailing edge of an ogive of the bullet coincides with a leading edge of the sleeve and a leading edge of a boattail of the bullet coincides with a trailing edge of the sleeve.

8. The improved bullet of claim 1, further comprising a plurality of curved annular segments on an outer surface of the sleeve configured to create a lateral crenelated shank and affect a Coanda air flow across the curved segments.

9. The improved bullet of claim 1, wherein the shank comprises a molded polymer material configured to shrink when it cools and firmly attach the sleeve to the reduced diameter shank in a molding operation where the shank is an insert and the sleeve is molded around it.

10. An improved bullet and freebore for a rifle barrel of a firearm, comprising:

a bullet shank having at least one reduced diameter waist;

a sleeve adapted to fill out the at least one reduced diameter waist so that a diameter of the sleeve over the shank waist is equal to or slightly greater than a minimum diameter of the firearm freebore and slightly greater than a bore of the rifle barrel;

a plurality of crenelated segments on the sleeve are configured to create a lateral crenelated shank and effect a Coanda air flow across the curved segments;

an extended freebore; and an annular dimple in a base of the bullet, the annular dimple comprising at least one of one or more annular troughs, a cylindrical counter bore and a concave counter bore in the bullet base, wherein the waisted sleeve and dimpled base are configured to extend an effective flight range and a Coanda effect there around reducing air turbulence and drag on the bullet shank in flight.

11. The improved bullet and extended freebore of claim 10, wherein a ratio of a concavity of a second curved segment to a convexity of a first curved segment is approximately one to one.

12. The improved bullet and extended freebore of claim 10, wherein an aspect ratio of a length of the bullet to a diameter thereof is larger than 1.75 plus or minus a ten percent manufacturing tolerance.

13. The improved bullet and extended freebore of claim 10, wherein a ratio of a concavity of a dimple to a convexity of the curved segment is approximately one to one.

14. The improved bullet and extended freebore of claim 10, wherein the extended freebore comprises a leading edge of the bullet shank configured to enter a cylindrical second section of a compound freebore before a trailing edge of the bullet shank exits a cartridge mouth and a trailing edge of the bullet shank leaves the case before the leading or the ogive makes contact with a leade of the barrel or rifling.

15. An improved bullet and freebore for a rifle barrel of a firearm comprising:

a bullet shank having at least one reduced diameter waist;

a sleeve adapted to fill out the at least one reduced diameter waist so that a diameter of the sleeve over the shank waist is equal to or slightly greater than a minimum diameter of the firearm freebore and slightly greater than a bore of the rifle barrel;

an annular dimple in a base of the bullet, the annular dimple comprising at least one of one or more annular troughs, a cylindrical counter bore and a concave counter bore in the bullet base;

an extended freebore;

a first curve segment on the sleeve of the bullet, the first curve segment comprising a convex center point within a shank profile of the bullet and forms an annular dimple therein; and a second curve segment on the sleeve of the bullet, the second curve segment comprising a concave center point outside the shank profile of the bullet and forms an annular trough there around, wherein the first curve segment and the second curve segment form a repeated 'S' shaped profile on the bullet shank, and wherein the waisted sleeve and dimpled base are configured to extend an effective flight range and a Coanda effect there around reducing air turbulence and drag on the bullet shank in flight.

16. The improved bullet and extended freebore of claim 15, further comprising an eight 8 mm bullet with a base annular trough, a sleeve-waisted shank and an extended freebore including a nominal 1.54" length, an 8 mm or 0.323" diameter projectile fitted to a shortened and necked out .223 Remington case 630 with a nominal COAL of 2.26".

17. The improved bullet and extended freebore of claim 15, further comprising a 308 bullet with a base annular trough, a sleeve-waisted shank and an extended freebore including a nominal 1.86" length, has an 7.62 mm or 0.308" diameter projectile 720 fitted to a lengthened and necked out .223 Remington case 730 with a nominal COAL of 2.81".

18. The improved bullet and extended freebore of claim 15, further comprising a gradual transition from the shank to a boattail of the bullet less than 18 degrees to avoid a slip stream around the bullet to separate prematurely and increase a wake turbulence zone and corresponding drag.

19. The improved bullet and extended freebore of claim 15, wherein a steel core of the bullet is treated with surface coatings including melonite, nitrocarburizing and nickel-boron configured to defeat advanced body armor.

20. The improved bullet and extended freebore of claim 15, wherein the extended freebore comprises a leading edge of the bullet shank configured to enter a cylindrical second section of a compound freebore before a trailing edge of the bullet shank exits a cartridge mouth and a trailing edge of the bullet shank leaves the case before the leading or the ogive makes contact with a leade of the barrel or rifling.

* * * * *